US011643911B2

(12) United States Patent
Radov et al.

(10) Patent No.: US 11,643,911 B2
(45) Date of Patent: May 9, 2023

(54) INTEGRATED ELECTRIC SUBMERSIBLE PUMPING SYSTEM WITH ELECTROMAGNETICALLY DRIVEN IMPELLER

(71) Applicant: SCHLUMBERGER TECHNOLOGY CORPORATION, Sugar Land, TX (US)

(72) Inventors: Maksim Radov, Singapore (SG); Ruslan Alexandrovich Bobkov, Singapore (SG); Souvik Dasgupta, Singapore (SG)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 271 days.

(21) Appl. No.: 16/320,524

(22) PCT Filed: Jun. 7, 2017

(86) PCT No.: PCT/US2017/036242
§ 371 (c)(1),
(2) Date: Jan. 25, 2019

(87) PCT Pub. No.: WO2018/022198
PCT Pub. Date: Feb. 1, 2018

(65) Prior Publication Data

US 2019/0271217 A1 Sep. 5, 2019

Related U.S. Application Data

(60) Provisional application No. 62/366,907, filed on Jul. 26, 2016.

(51) Int. Cl.
*E21B 43/12* (2006.01)
*F04D 1/06* (2006.01)
(Continued)

(52) U.S. Cl.
CPC ..... *E21B 43/128* (2013.01); *E21B 43/12* (2013.01); *F04D 1/06* (2013.01); *F04D 13/0693* (2013.01);
(Continued)

(58) Field of Classification Search
CPC ..... E21B 43/13; F04D 29/04; F04D 29/186; F04D 29/2227; F04D 29/42; F04D 29/528; F04D 29/54; F04D 13/0693; F04D 1/063
See application file for complete search history.

(56) References Cited

U.S. PATENT DOCUMENTS 2,887,062 A * 5/1959 Cametti ..... F04D 13/08 417/357
4,511,307 A 4/1985 Drake
(Continued)

FOREIGN PATENT DOCUMENTS

CA 2623365 A1 4/2002
CN 101534024 A 9/2009
(Continued)

OTHER PUBLICATIONS

Search Report and Written Opinion of International Patent Application No. PCT/US2017/036242 dated Sep. 4, 2017, 15 pages.
(Continued)

*Primary Examiner* — Nathan C Zollinger
*Assistant Examiner* — Timothy P Solak
(74) *Attorney, Agent, or Firm* — Jeffrey D. Frantz

(57) ABSTRACT

An electric submersible pumping system is constructed with an outer housing which contains an integrated pump and motor. The pump may comprise an impeller disposed within a stator of the motor to form an integrated pump and the motor. An electric submersible pumping system includes a stator having a passage extending longitudinally through the
(Continued)

stator. A plurality of stages, including impellers and diffusers, are disposed within the passage.

14 Claims, 8 Drawing Sheets

(51) Int. Cl.

| | |
|---|---|
| ***F04D 13/10*** | (2006.01) |
| ***F04D 29/02*** | (2006.01) |
| ***F04D 29/40*** | (2006.01) |
| ***F04D 29/22*** | (2006.01) |
| ***F04D 13/08*** | (2006.01) |
| ***F04D 29/041*** | (2006.01) |
| ***F04D 31/00*** | (2006.01) |
| ***F04D 13/06*** | (2006.01) |
| ***F04D 29/18*** | (2006.01) |
| *F04D 13/14* | (2006.01) |
| *F04D 29/54* | (2006.01) |
| *F04D 29/52* | (2006.01) |
| *F04D 29/04* | (2006.01) |

(52) U.S. Cl.

CPC ..... *F04D 13/086* (2013.01); *F04D 13/10* (2013.01); *F04D 29/026* (2013.01); *F04D 29/041* (2013.01); *F04D 29/186* (2013.01); *F04D 29/2227* (2013.01); *F04D 29/406* (2013.01); *F04D 31/00* (2013.01); *F04D 13/0646* (2013.01); *F04D 13/14* (2013.01); *F04D 29/04* (2013.01); *F04D 29/528* (2013.01); *F04D 29/54* (2013.01)

(56) References Cited

U.S. PATENT DOCUMENTS

| | | | | |
|---|---|---|---|---|
| 4,541,782 | A | 9/1985 | Mohn | |
| 4,678,399 | A | 7/1987 | Vandevier et al. | |
| 4,741,668 | A | 5/1988 | Bearden | |
| 4,872,808 | A | 10/1989 | Wilson | |
| 5,209,650 | A * | 5/1993 | Lemieux | F01D 15/10 384/115 |
| 5,211,546 | A * | 5/1993 | Isaacson | A61M 60/806 604/151 |
| 5,547,350 | A | 8/1996 | Rawal et al. | |
| 5,713,727 | A | 2/1998 | Veronesi et al. | |
| 5,722,812 | A | 3/1998 | Knox et al. | |
| 6,053,705 | A * | 4/2000 | Schob | A61M 60/205 417/53 |
| 6,068,444 | A | 5/2000 | Sheth | |
| 6,244,835 | B1 * | 6/2001 | Antaki | F04D 13/0646 417/423.1 |
| 6,254,359 | B1 * | 7/2001 | Aber | F04D 29/0465 417/356 |
| 6,726,449 | B2 | 4/2004 | James et al. | |
| 6,811,382 | B2 * | 11/2004 | Buchanan | F04D 15/029 417/244 |
| 7,021,905 | B2 | 4/2006 | Torrey et al. | |
| 7,326,034 | B2 * | 2/2008 | Sheth | F04D 13/10 415/199.2 |
| 7,575,413 | B2 | 8/2009 | Semple et al. | |
| 8,454,330 | B2 | 6/2013 | Lyngholm | |
| 8,772,997 | B2 * | 7/2014 | Rumbaugh | H02K 3/38 310/215 |
| 9,334,865 | B2 | 5/2016 | Johnson et al. | |
| 2002/0066568 | A1 * | 6/2002 | Buchanan | H02K 5/132 166/313 |
| 2008/0111434 | A1 | 5/2008 | Head | |
| 2009/0078412 | A1 * | 3/2009 | Kanayama | F04D 13/024 166/250.15 |
| 2009/0162223 | A1 * | 6/2009 | Lyngholm | F04D 13/08 417/410.1 |
| 2013/0115118 | A1 | 5/2013 | Chien et al. | |
| 2013/0236341 | A1 * | 9/2013 | Andersen | F04D 13/12 415/207 |
| 2015/0023815 | A1 | 1/2015 | Tetzlaff et al. | |
| 2015/0104335 | A1 * | 4/2015 | Faller | F04D 29/5806 417/244 |

FOREIGN PATENT DOCUMENTS

| | | | |
|---|---|---|---|
| FR | 2678987 | A1 | 1/1993 |
| GB | 1085042 | A | 9/1967 |
| GB | 2254656 | A | 10/1992 |
| GB | 2369862 | A | 6/2002 |
| WO | 2015094249 | A1 | 6/2015 |
| WO | 2018022198 | A1 | 2/2018 |
| WO | 2020198446 | A1 | 10/2020 |

OTHER PUBLICATIONS

International Preliminary Report on Patentability of International Patent Application No. PCT/US2017/036242 dated Feb. 7, 2019, 12 pages.

International Search Report and Written Opinion issued in the PCT Application PCT/US2020/024909, dated Jul. 13, 2020 (16 pages).

* cited by examiner

INTEGRATED ELECTRIC SUBMERSIBLE PUMPING SYSTEM WITH ELECTROMAGNETICALLY DRIVEN IMPELLER

CROSS-REFERENCE TO RELATED APPLICATION

The present document is based on and claims priority to U.S. Provisional Application Ser. No. 62/366,907, filed Jul. 26, 2016, which is incorporated herein by reference in its entirety.

BACKGROUND

Following discovery of a desired subterranean resource, e.g. oil, natural gas, or other desired subterranean resources, well drilling and production systems often are employed to access and extract the resource or resources. For example, a wellbore may be drilled into a hydrocarbon bearing reservoir and then a pumping system may be deployed downhole. The pumping system is operated to pump oil and/or other fluids to the surface for collection when the natural drive energy of the reservoir is not strong enough to lift the well fluids to the surface. The pumping system may comprise an electric submersible pumping system having a submersible centrifugal pump powered by a separate submersible electric motor.

SUMMARY

In general, the present disclosure provides a system and methodology for pumping fluids. According to an embodiment, an electric submersible pumping system is constructed with an outer housing which contains an integrated pump and motor. For example, the pump may comprise an impeller disposed within a stator of the motor. The integration of the pump and the motor enables elimination of various components of traditional electric submersible pumping systems to thus provide a simpler and more compact system for pumping fluids.

BRIEF DESCRIPTION OF THE DRAWINGS

Certain embodiments will hereafter be described with reference to the accompanying drawings, wherein like reference numerals denote like elements. It should be understood, however, that the accompanying figures illustrate various implementations described herein and are not meant to limit the scope of various technologies described herein, and.

DETAILED DESCRIPTION

Figure 1:
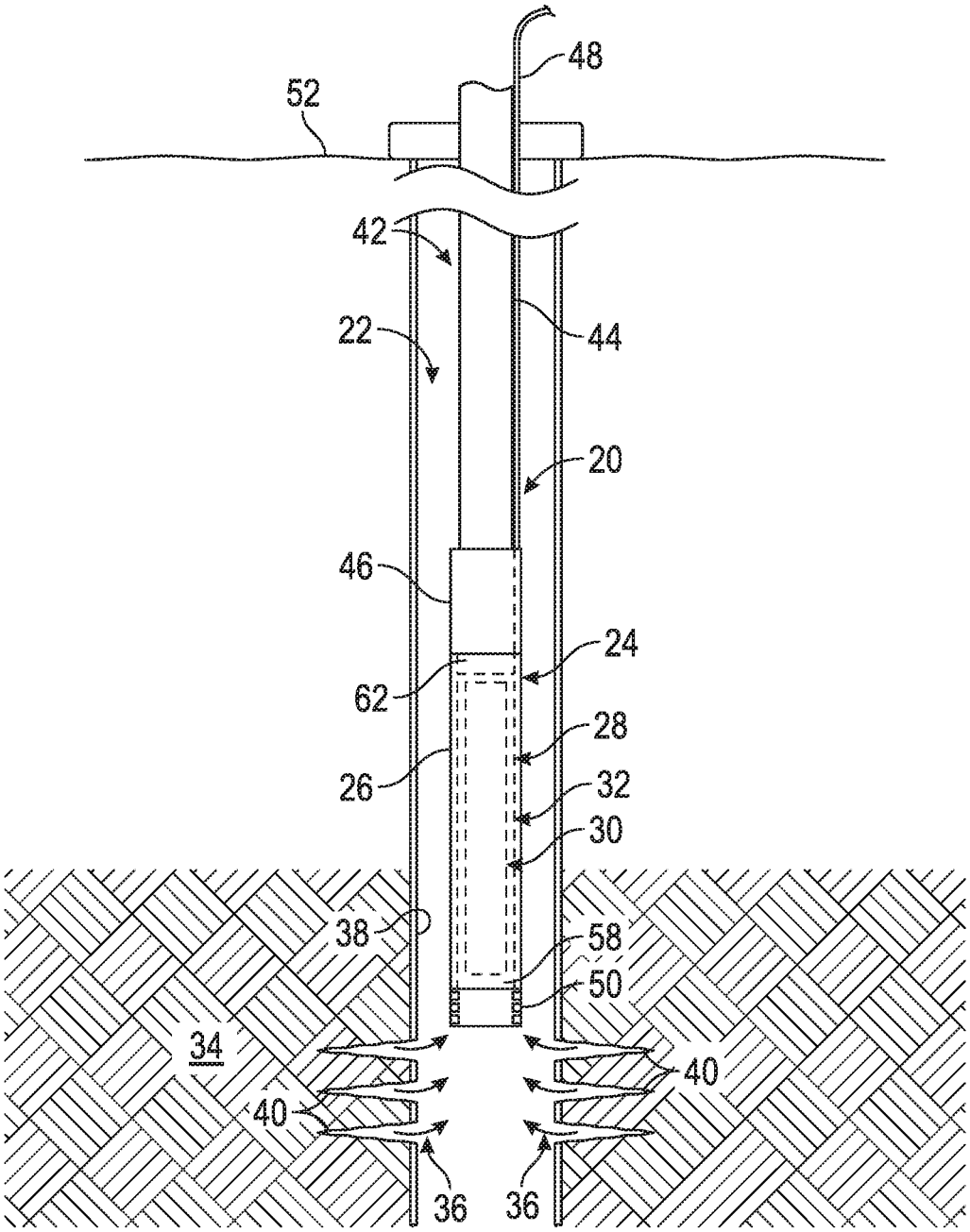
FIG. 1 is a schematic illustration of an example of a well system including an electric submersible pumping (ESP) system, according to an embodiment of the disclosure.

In the following description, numerous details are set forth to provide an understanding of some illustrative embodiments of the present disclosure. However, it will be understood by those of ordinary skill in the art that the system and/or methodology may be practiced without these details and that numerous variations or modifications from the described embodiments may be possible.

The disclosure herein generally relates to a system and methodology for pumping fluids, e.g. well fluids. According to an embodiment, an electric submersible pumping system is constructed for deployment in a borehole or other suitable location to pump desired fluids. The electric submersible pumping system may be constructed with an outer housing containing an integrated pump and motor. For example, the pump may comprise an impeller disposed within a stator of the motor. The integration of the pump and the motor enables elimination of various components of traditional electric submersible pumping systems to thus provide a simpler and more compact system for pumping fluids.

According to an embodiment of the integrated pump and motor, the stator is disposed within the outer housing and comprises a stack of stator laminations having a bore extending longitudinally through the stack. The stator further comprises a plurality of slots disposed around the bore combined with magnet wire disposed within the slots. An impeller is disposed within the stator and comprises an impeller body, a magnetic component about the impeller body, and a permanent magnet. By way of example, the permanent magnet may be mounted about the magnetic component. In this embodiment, the impeller is positioned within the bore extending through the stack of stator laminations to provide the integrated pump and motor. In various embodiments, the integrated pump and motor comprises a stack of impellers and corresponding diffusers located within the stator.

For well applications, the electric submersible pumping system may be used for lifting well fluids to, for example, a surface location. Embodiments of the electric submersible pumping system integrate an electrical motor with a pump to provide a simple pumping system of convenient size. In some embodiments, the electrical motor may be constructed with a stator having a magnetic core and a winding sealed from the ambient environment or made of materials which are not susceptible to the ambient environment. In various embodiments, centrifugal pump stages may be installed within an inside diameter of the stator.

By way of example, the centrifugal pump stages may comprise stationary diffusers which may be fixed to the stator, e.g. fixed within the inner diameter of the stator. In some embodiments, the stationary diffusers may be positioned within the stator and fixed along a stationary shaft. The impellers may be equipped with components that generate torque while being exposed to a rotating magnetic field resulting by applying electric power to the stator. Examples of components that generate torque include permanent magnets, squirrel cage rotors, switched reluctance or synchronous reluctance rotors, or other suitable torque generating components. In some embodiments, the impellers may be installed on a rotating shaft in packs and the packs may be radially stabilized by radial fluid film bearings installed in corresponding, stationary diffusers.

The stator may be constructed with multi-phase winding and may be fed with AC voltage to generate a rotational magnetic field within the stator inner diameter. The rotating magnetic field interacts with the torque generating components of the impellers, thus causing the impellers to rotate and to thus pump fluid through the integrated pump and motor.

Referring generally to FIG. 1, an embodiment of an electric submersible pumping system 20 is illustrated as deployed downhole into a borehole 22, e.g. a wellbore, for production of desired fluids, e.g. oil. Electric submersible pumping system 20 may comprise a variety of components depending on the particular application or environment in which it is used. By way of example, the electric submersible pumping system 20 may comprise a pumping section 24 having an outer housing 26 containing an integrated pump and motor 28. The integrated pump and motor 28 effectively combines a pump 30 and a motor 32 within the outer housing 26 to provide a simple, compact structure for pumping fluids, e.g. well fluids. The pump 30 of integrated pump and motor 28 may comprise floater stages, compression stages, or modular compression with impeller flow passages oriented to provide radial flow, mixed flow, axial flow, or other desired flow patterns through the integrated pump and motor 28.

In the embodiment illustrated, the borehole 22 is in the form of a wellbore drilled into a geological formation 34 which contains a desirable fluid 36, e.g. a production fluid such as oil. The borehole 22 may be lined with a tubular casing 38 and perforations 40 may be formed through casing 38 to enable flow of fluids between the surrounding formation 34 and the borehole/wellbore 22. The electric submersible pumping system 20 may be deployed down into borehole 22 via a conveyance system 42. By way of example, the conveyance system 42 may comprise tubing 44 (e.g. coiled tubing, production tubing) or cable coupled with pumping section 24 via a connector 46.

Electric power may be provided to the motor 32 of pumping section 24 via a power cable 48. This allows the motor 32 to power pump 30, as described in greater detail below, so as to draw in fluid 36 through a suitable pump intake 50. The pump 30 may comprise an impeller or impellers which are rotated by an electromagnetic interaction with a rotating magnetic field generated by motor 32 to produce the fluid 36 through the integrated pump and motor 28. In well applications, the fluid 36 may be produced up through tubing 44 (or along an annulus surrounding tubing 44) to a desired collection location which may be at a surface 52 of the earth.

According to an embodiment, the pump 30 may be a multi-stage centrifugal pump. Each stage may comprise an impeller working in cooperation with a stationary diffuser. The impellers are driven by the magnetic field of the motor 32 such that vanes of the rotating impellers convert the driver/motor energy to kinetic energy which is applied to the fluid. The fluid is thus thrown outward by the impeller vanes in a direction away from the center of the impeller. The fluid discharged from the impeller may first contact the inner wall of the adjacent, cooperating diffuser. In some embodiments, the impeller may be rotatably mounted within the cooperating diffuser. The cooperating diffusers direct the flowing fluid from one impeller to the next until the flowing fluid is discharged from the pumping section 24. In some downhole centrifugal pumping systems, the number of pump stages may be determined by the total dynamic head (TDH), stage type performance characteristics, and desired flow rate. For deep wells where high TDH is desired, the overall pumping system may comprise a plurality of the pumping sections 24 connected in tandem hydraulically and electrically.

In embodiments of the disclosure, a motor stator and hydraulic centrifugal pump are combined in a single assembly. The stator may be represented by a laminated magnetic core with multi-phase winding distributed in slots. The winding may be fed by multi-phase AC voltage creating a rotating magnetic field over the space within the stator inner diameter (ID). The stator ID may be sealed from the ambient environment by a corrosion and erosion resistant material of cylindrical shape (e.g. a "can"). In some embodiments of the disclosure, the stator may be constructed from materials resistant to the ambient environment or from a stack of lamination packs individually sealed from the ambient environment by isolating material, e.g. plastic. According to an arrangement, magnetic lamination packs may alternate with non-magnetic packs located adjacent to non-torque producing components of the pump, e.g. diffusers, to reduce power loss in the magnetic core of the stator.

According to an embodiment, non-magnetic stationary diffusers may be installed inside the stator ID. The non-magnetic diffusers may be fixed at desired positions within the stator. For example, the non-magnetic diffusers may be fixed tangentially by, for example, engagement of locking keys with corresponding key grooves located along the stator ID. In some applications, the stack of diffusers may be compressed from the ends of the stack. Furthermore, some embodiments may lock the non-magnetic diffusers along a stationary shaft via keys or other locking mechanisms. In some embodiments, each diffuser may have a two-piece construction in which one part has vanes made of magnetic material and the other part, adjacent to the torque producing impeller, is made of a non-magnetic material, e.g. ceramic or other erosion and corrosion resistant material.

Each impeller installed inside the stator ID may be constructed of magnetic or non-magnetic material. Torque generating components or subassemblies such as permanent magnets, squirrel cage rotors, switched reluctance or synchronous reluctance rotors, or other torque generating components may be fixed on the impeller or formed as integral parts of the impeller. For example, permanent magnets or other torque generating components may be fixed in the front seal area (front skirt) or in the balance ring area of each impeller. The torque generating components are positioned to interact with the rotating magnetic field of the stator and to generate torque for driving the impellers. Rotating impellers and stationary diffusors are able to transform rotational kinetic energy into the hydrodynamic energy of the fluid flow.

In some embodiments of the disclosure, the entire impeller or the vanes of the impeller may be made of a magnetic material. By way of example, the entire impeller or portions of the impeller may be constructed from magnetic steel or other suitable magnetic material. The magnetic impeller is thus able to interact electromagnetically with a rotating magnetic field of the stator such that the impeller functions simultaneously as the impeller of centrifugal pump and the rotor of the motor.

Each impeller may have its own axial and radial support in the form of a bearing made of wear resistant material, e.g., a ceramic or carbide material. The plurality of impellers may be assembled collectively or in separate packs. Additionally, the entire group of impellers or packs of the impellers may be assembled in a floater configuration or in compression. In some applications, the impellers may be rotated about or with a corresponding central shaft. At least some of these configurations may allow for increases in rotating torque within pump stages to prevent the pump from getting stuck due to abrasives.

Embodiments of the disclosure allow for the elimination of traditional ESP components such as the motor protector, intake, separate pump and motor sections, shafts, couplings, and the motor lead extension. Embodiments of the disclosure also may allow for the overall system efficiency to remain at, or be higher than, the level of conventional ESP system efficiency due to the use of high efficiency electrical machine design with high-efficiency hydraulic pump design without compromising either electromagnetic or hydraulic design. Shaft-less design configurations may allow for pump stages with the head of, and higher efficiency than, a conventional centrifugal pump stage due to an increased working area. Pump and motor integration into a single section may reduce the number of parts and shorten the total length of the ESP. A reduction in the number of sections also may minimize installation time at the wellsite and reduce the probability of failure caused by human error, thus increasing reliability. Elimination of torque transmission components such as shafts and couplings may allow flexible connections between integrated pumping sections which, in turn, can facilitate use of the electric submersible pumping system 20 in wells having high dogleg severity.

Figure 2:
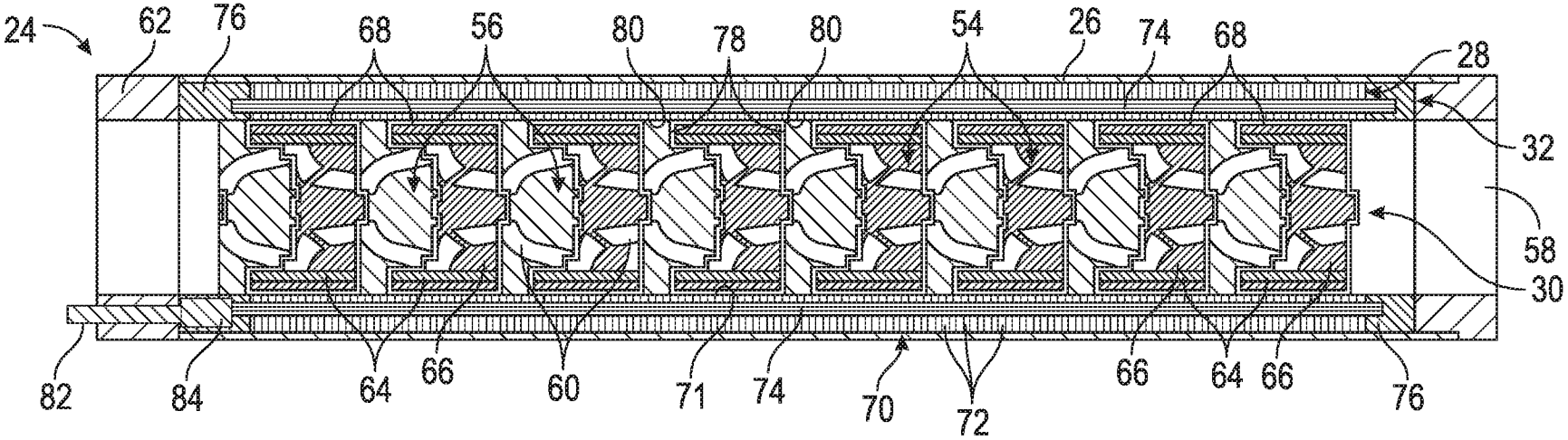
FIG. 2 is a cross-sectional illustration of an example of an integrated pump and motor of the ESP system, according to an embodiment of the disclosure.

Referring generally to FIG. 2, an embodiment of at least a portion of electric submersible pumping system 20 is illustrated. In this example, the pumping section 24 comprises integrated pump and motor 28 disposed within outer housing 26. The integrated pump and motor 28 comprises pump 30 which may be in the form of a centrifugal pump having at least one impeller 54 and at least one diffuser 56. In these types of embodiments, the at least one impeller 54 may comprise various styles of impeller vanes for moving fluid upon impeller rotation. However, pump 30 and impeller 54 may be constructed in various other types of configurations. In the illustrated embodiment, the pump 30 comprises a plurality of impellers 54 positioned in cooperation with corresponding diffusers 56. As described in greater detail below, the impellers 54 may be magnetic impellers and the diffusers 56 may be non-magnetic diffusers.

During operation, the plurality of impellers 54 receives fluid, e.g. well fluid through an intake 58 (which receives fluid from system pump intake 50) and directs the fluid to the next sequential diffuser 56 which, in turn, directs the fluid to the next sequential impeller 54. The fluid flows along a flow path 60 through sequential impellers 54 and diffusers 56 until being discharged through a discharge head 62. The flow path 60 may be in the form of a fluid conduit for transporting fluid from a first side to a second side of each impeller 54 and from a first side to a second side of each diffuser 56 sequentially. In this example, each impeller 54 further comprises a magnetic component 64 which may be disposed at various positions within the impeller 54 or along the exterior of impeller 54. By way of example, each magnetic component 64 may be annular in shape and have the form of a ring or cylinder disposed about a body 66 of the impeller 54.

As illustrated, each impeller 54 also may comprise a magnet 68, e.g. a permanent magnet, positioned at an external location with respect to the impeller body 66. By way of example, each magnet 68 may be annular in shape and in the form of a ring or cylinder positioned around the corresponding magnetic component 64.

Functionally, the magnetic component 64 and magnet 68 may be considered part of the motor 32. Because the magnetic components 64 and magnets 68 of impellers 54 are fixed to the impeller bodies 66, motor 32 is able to rotate the impellers 54 so as to pump fluid from intake 58 and out through discharge head 62. It should be noted the magnetic component 64 and magnet 68 may be combined with the corresponding impeller body 66 on an individual impeller 54 or on groups of impellers 54 selected from the overall group of impellers 54.

In this example, the motor 32 comprises a stator 70 disposed along the interior of outer housing 26. The stator 70 may be annular in form and have a central passage 71, e.g. a bore, therethrough. The stator 70 may be constructed with a magnetic core and/or with materials having desired magnetic or electric anisotropy. In some embodiments, the stator 70 is constructed with a plurality of stacked stator laminations 72. A magnet wire 74 (or magnet wires) may extend through the stator 70 in a generally lengthwise direction. By way of example, magnet wire passages, e.g. slots, may be formed longitudinally through the stator 70, e.g. through the stack of stator laminations 72, and the magnet wire 74 may be fed through the magnet wire passages to form a stator coil. Longitudinal ends of the magnet wire may be contained by coil end encapsulations 76, e.g. by a coil end encapsulation 76 located at each end of the stacked stator laminations 72.

The non-magnetic diffusers 56 may be held in stationary positions with respect to stator 70. By way of example, each diffuser 56 may be locked to the surrounding stator 70 via a key or other protuberance 78 of each diffuser 56 engaging a corresponding recess 80 located along an inside diameter of the stator 70. Consequently, the non-magnetic diffusers 56 are prevented from rotating during rotation of impellers 54 while operating the integrated pump and motor 28.

To cause operation of motor 32 and pumping of fluid via pump 30, electricity is supplied to magnet wire 74 via an electric cable 82 coupled with magnet wire 74 via a cable connector 84. Electric cable 82 may be the same as or part of overall power cable 48. The rotating magnetic field created by electricity flowing along the winding created by coiled magnet wire 74 extends to the inside diameter of stator 70 and interacts with magnetic impellers 54, e.g. with magnetic components 64 and corresponding magnets 68. For example, the magnets 68 may be oriented to provide appropriately positioned polarity along the outer surface of the impellers 54. In this manner, the stator 70, magnetic components 64, and corresponding magnets 68 function as an electric motor and cause rotation of the impellers 54. The structure of impellers 54 enables the impellers 54 to function as a rotor of the motor 32 while also facilitating pumping of fluid along pump 30. According to at least some embodiments described herein, the magnetic gap between the stator 70 and the magnets 68 is constant and continuous. In the example illustrated in FIG. 2, the impellers 54 may rotate independently with respect to each other.

Figure 3:
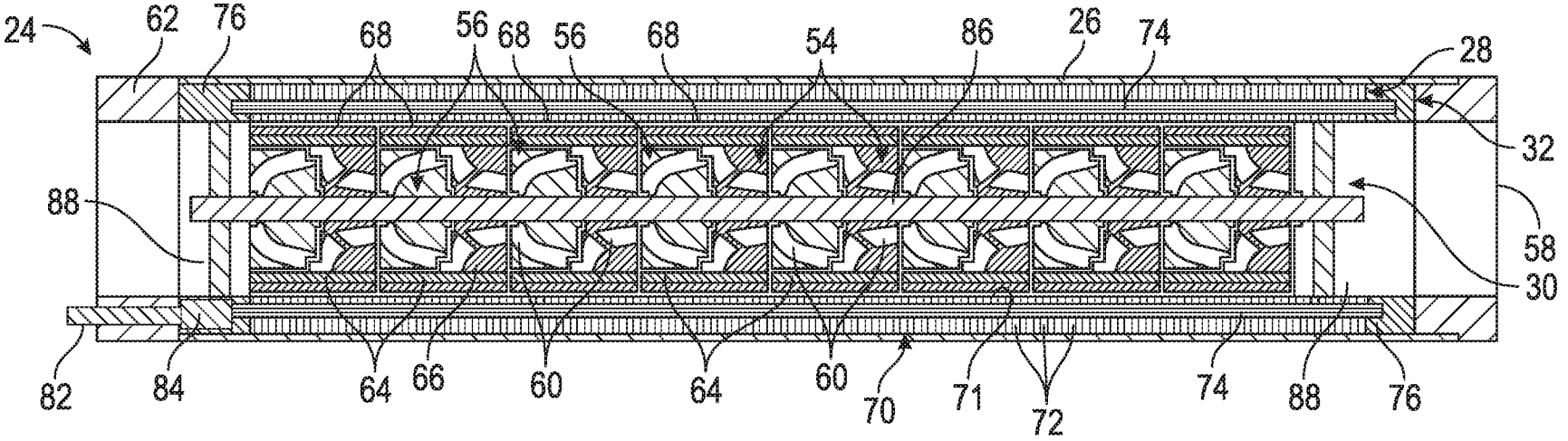
FIG. 3 is a cross-sectional illustration of another example of an integrated pump and motor of the ESP system, according to an embodiment of the disclosure.

Referring generally to FIG. 3, another embodiment of pumping section 24 is illustrated. In this example, the integrated pump and motor 28 comprises a stationary shaft 86 extending generally along a central axis of the pumping section 24. The shaft 86 is fixed in a stationary position within housing 26 via shaft fixators 88 coupled between, for example, the shaft 86 and housing 26 (or between the shaft 86 and stator 70). In this example, the stationary, non-magnetic diffusers 56 are locked to stationary shaft 86. However, the impellers 54 may freely rotate about the shaft 86. In some embodiments, the impellers 54 may rotate about shaft 86 independently with respect to each other or in desired groups.

In this embodiment, stator 70 may again comprise a winding of magnet wire 74 which is supplied with electricity via electric cable 82. The resulting magnetic field is used to rotate impellers 54 which cause the inflow of fluid through intake 58 and the discharge of fluid through discharge head 62. The flowing fluid, e.g. well fluid, passes through the plurality of non-magnetic diffusers 56 and magnetic impellers 54 before being discharged through discharge head 62.

Figure 4:
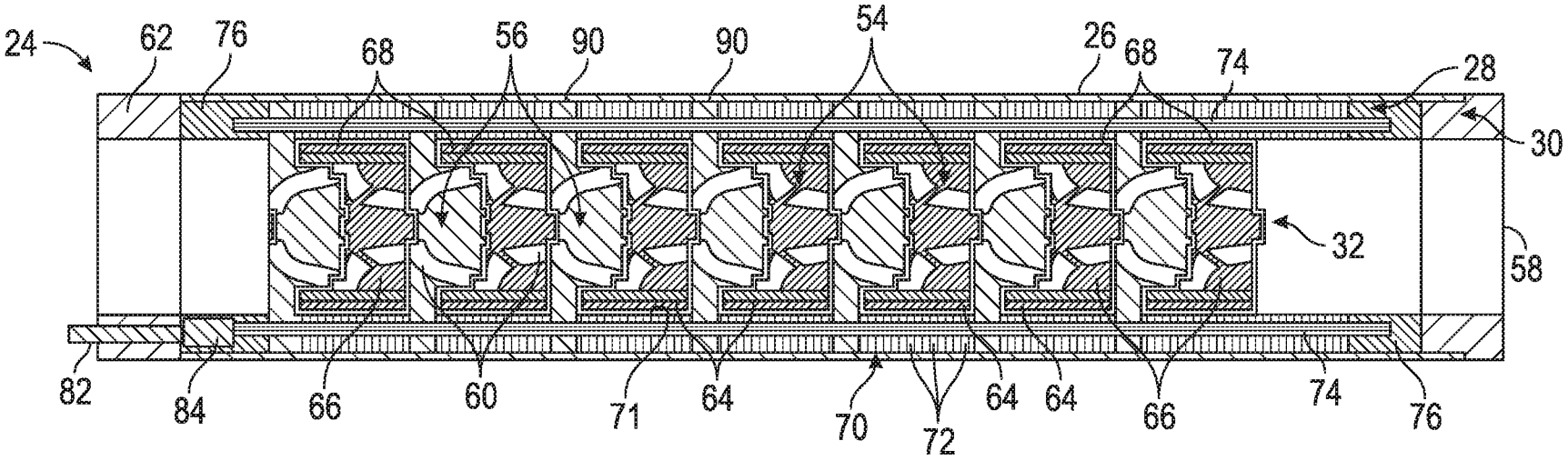
FIG. 4 is a cross-sectional illustration of another example of an integrated pump and motor of the ESP system, according to an embodiment of the disclosure.

Referring generally to FIG. 4, another embodiment of pumping section 24 is illustrated. In this example, the non-magnetic diffusers 56 include flanges 90 which extend to an inside surface of outer housing 26. The flanges 90 extend through stator 70 and interrupt the continuity of the stator laminations 72. The magnet wire 74 extends through both the stator laminations 72 and the flanges 90 to provide a suitable winding for enabling rotation of impellers 54 when electric power is supplied via electric cable 82 and a rotating magnetic field is established via stator 70. In this embodiment, the diffusers 56 and the stator laminations 72 may be compressed together to provide higher down-thrust capability of the stages. It should be noted stages, as used herein, means adjacent pairings of impeller 54 and diffuser 56. Depending on the pumping capacity desired, different numbers of stages (pairs of impellers 54 and diffusers 56) may be assembled to form the integrated pump and motor 28. The embodiment illustrated in FIG. 4 also may help reduce core loss which otherwise may result from unused stator laminations where there is no corresponding rotor magnet zone.

Figure 5:
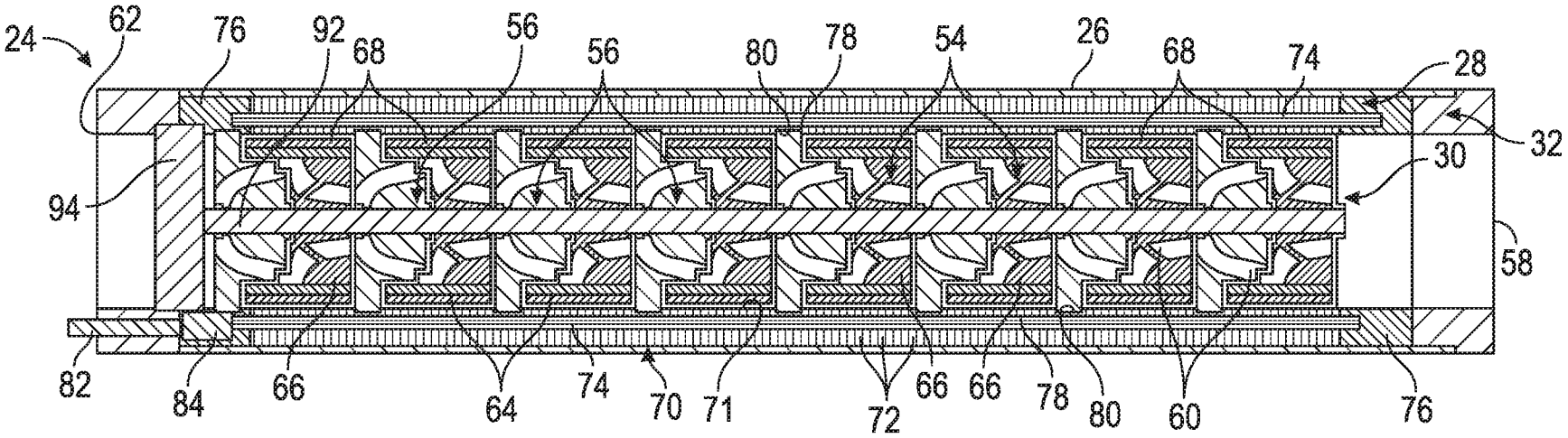
FIG. 5 is a cross-sectional illustration of another example of an integrated pump and motor of the ESP system, according to an embodiment of the disclosure.

Referring generally to FIG. 5, another embodiment of pumping section 24 is illustrated. In this example, the non-magnetic diffusers 56 are again locked in a stationary position with respect to stator 70 by, for example, protuberances 78 and corresponding recesses 80. However, a shaft 92, e.g. a rotatable shaft, is disposed through magnetic impellers 54 and non-magnetic diffusers 56. The shaft 92 may be supported by at least one shaft thrust bearing 94. For example, the shaft 92 may be supported on both ends by corresponding thrust bearings 94. In this embodiment, the magnetic impellers 54 may be rotationally constrained on shaft 92 by, for example, keys and a corresponding keyway or other suitable locking mechanisms. By locking the magnetic impellers 54 on shaft 92, the total load torque transmission is shared by each impeller/stage during torque generation, e.g. during operation of motor 32. Thus, if a stage/impeller becomes stuck the accumulation of stage torque on the shaft 92 may aid in freeing the stuck stage/impeller.

Figure 6:
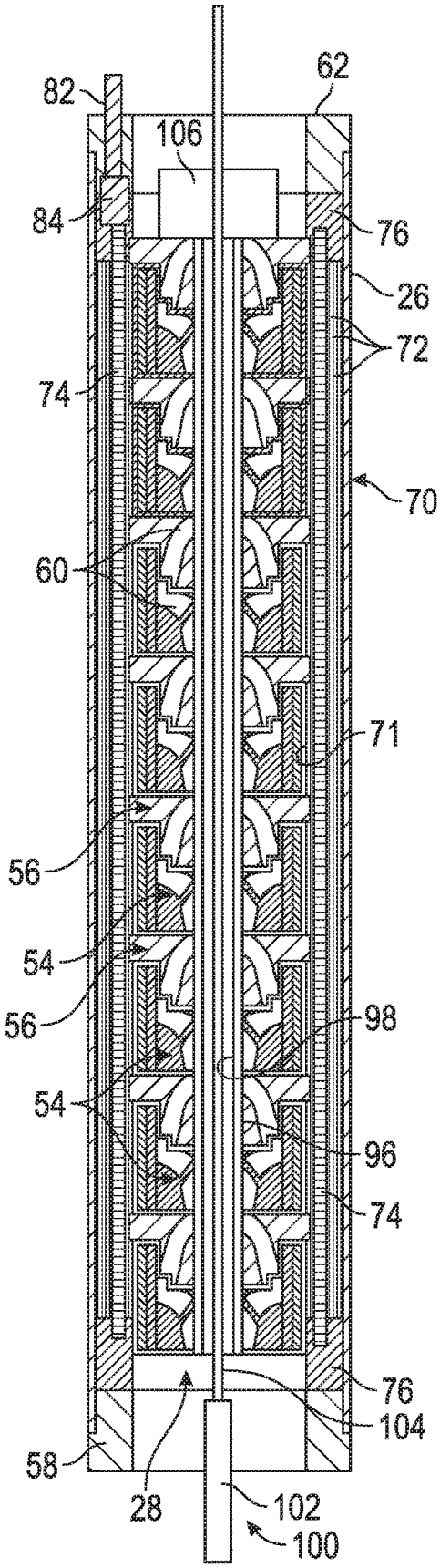
FIG. 6 is a cross-sectional illustration of another example of an integrated pump and motor of the ESP system, according to an embodiment of the disclosure.

Referring generally to FIG. 6, another embodiment of pumping section 24 is illustrated. In this example, a hollow shaft 96 is disposed through magnetic impellers 54 and non-magnetic diffusers 56. The hollow shaft 96 comprises an internal passage 98 sized for receiving a tool 100 therethrough. By way of example, the tool 100 may be in the form of a wireline logging tool 102 coupled with a logging tool cable 104 and passed through hollow shaft 96 via passage 98. The tool 100 may be deployed through the hollow shaft 96 to, for example, a position below the electric submersible pumping system 20.

The hollow shaft 96 may be used with a variety of embodiments. For example, the shaft 86 or the shaft 92, described above, may be constructed as hollow shaft 96. In some embodiments, a valve 106 may be mounted at the top of pumping section 24 or at another suitable location. The valve 106 may be in the form of a check valve or other suitable valve which is closed to block passage 98 when the pumping system is activated. However, the valve 106 may be moved to an open position to allow tool 100 to be passed through the hollow shaft 96.

Figure 7:
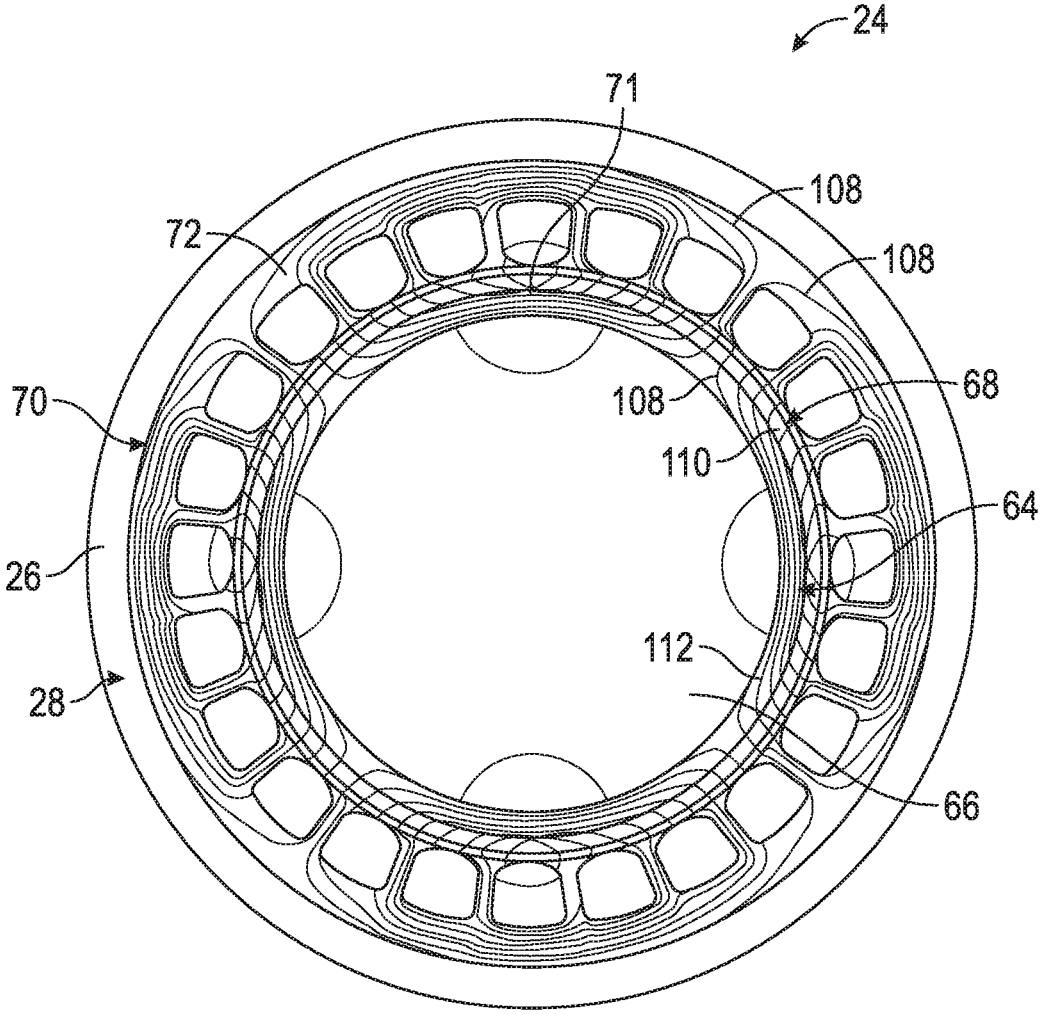
FIG. 7 is a cross-sectional illustration taken through an axis of an embodiment of the integrated pump and motor to illustrate magnetic lines, according to an embodiment of the disclosure.

In FIG. 7, a cross-sectional illustration of the integrated pump and motor 28, taken perpendicularly through the axis of the integrated pump and motor 28, is provided to show an example of an arrangement of magnetic lines 108. In this example, the motor 28 comprises stator 70 and is arranged in the form of a 3-phase, 4-pole, 24-slot configuration. Additionally, the impellers 54 are each arranged to have magnet 68 in the form of a permanent magnet ring 110 and magnetic component 64 in the form of a magnetic steel hub 112. Thus, each impeller 54 includes impeller body 66, magnetic steel hub 112, and permanent magnet ring 110. The impellers 54 are disposed within the passage/bore 71 formed by the inner diameter of stator 70. For example, the passage 71 may be formed along the interior of stator laminations 72 within outer housing 26.

Figure 8:
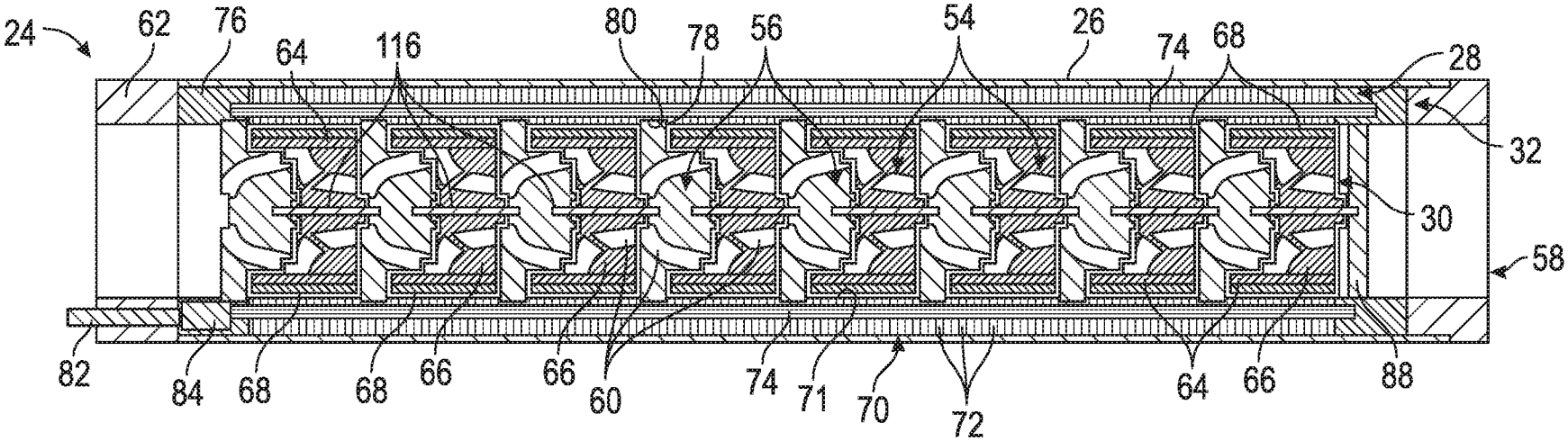
FIG. 8 is a cross-sectional illustration of another example of an integrated pump and motor of the ESP system, according to an embodiment of the disclosure.

Referring generally to FIG. 8, another embodiment of pumping section 24 is illustrated. In this example, a pin 116 or a plurality of pins 116 may be used to connect sequential magnetic impellers 54. By way of example, the pin(s) 116 may be located along an axis of the pumping section 24. In this embodiment, the pin or pins 116 are constructed for providing radial and/or axial stability rather than for transferring torque as with certain types of shafts. As with other embodiments, the magnet wire 74 may extend through the stator laminations 72 to enable rotation of impellers 54 when electric power is supplied via electric cable 82.

Depending on the parameters of a given application, the torque producing component, e.g. impeller 54, may be constructed in a variety of forms. In embodiments described above, for example, a torque producing component or components may be created using an impeller body 66 combined with a magnetic component 64 and an annular permanent magnet 68. However, the torque producing component, e.g. magnetic components of impeller 54, may be constructed in various other configurations. Examples of such configurations include an induction cage, a reluctance rotor, or another suitable component able to generate torque when electricity is applied via cable 82.

Figure 9:
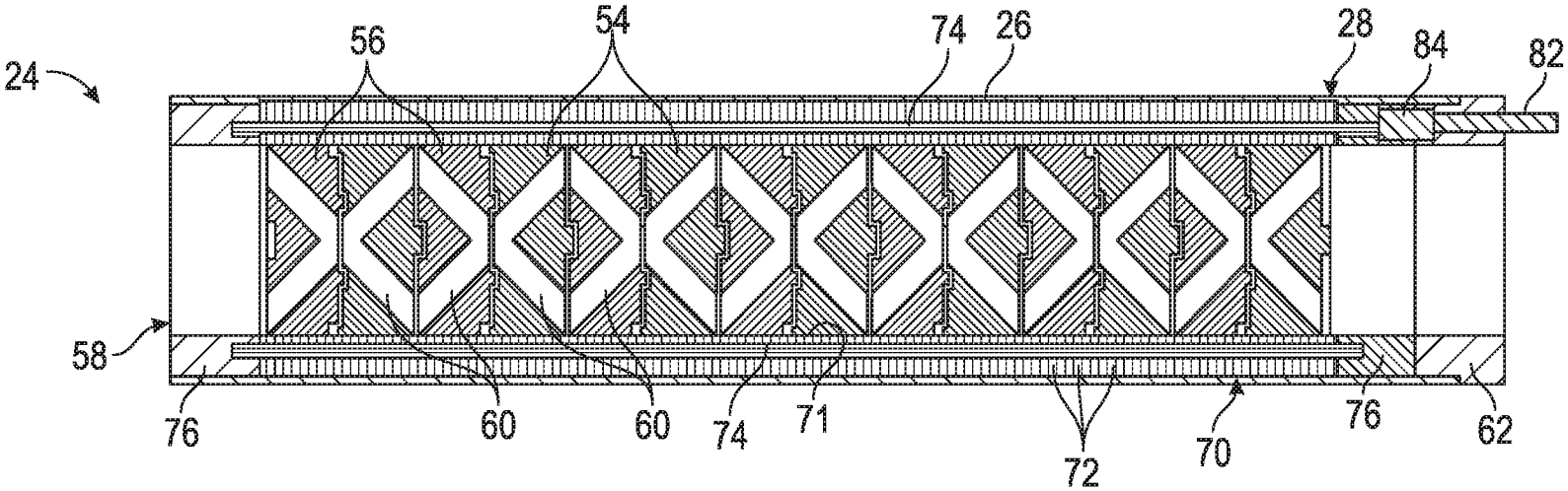
FIG. 9 is a cross-sectional illustration of another example of an integrated pump and motor of the ESP system, according to an embodiment of the disclosure.

Referring generally to FIG. 9, another embodiment of pumping section 24 is illustrated. In this example, impellers 54 are constructed from a magnetic material which electromagnetically interacts with stator magnetic poles of stator 70. As with other embodiments described herein, the impellers 54 are constructed to function as a rotor of motor 32 for interaction with the stator magnetic poles. Simultaneously, the impellers 54 function as conventional pump impellers of pump 30 so as to move fluid, e.g. well fluid, generally in an axial direction along flow channel 60.

Figure 10:
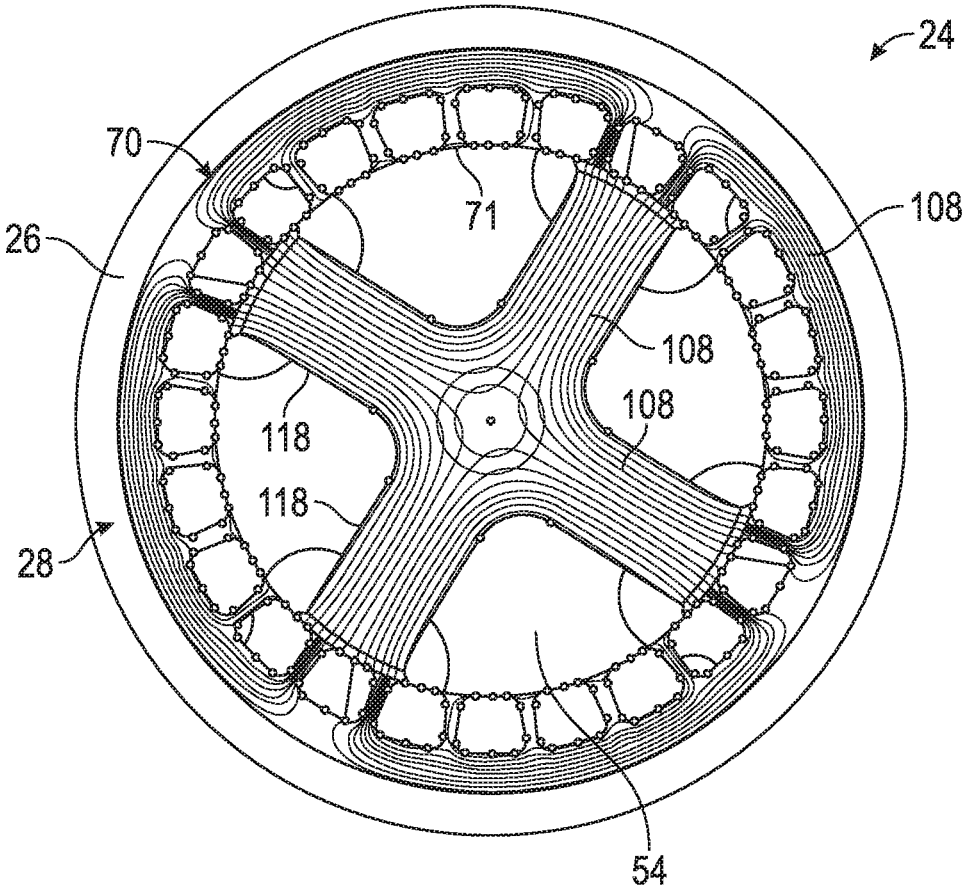
FIG. 10 is a cross-sectional illustration taken through an axis of another embodiment of the integrated pump and motor to illustrate magnetic lines, according to an embodiment of the disclosure.

In FIG. 10, a cross-sectional illustration of the integrated pump and motor 28, taken perpendicularly through the axis of the integrated pump and motor 28, is provided to show another example of an arrangement of magnetic lines 108. In this example, the impellers 54 each comprise impeller vanes 118 which are made of magnetic material. The magnetic material allows the impellers 54 to function as both a motor rotor and a pump impeller simultaneously. In this example, the impellers 54 are constructed such that the motor 32 operates as a reluctance motor.

Figure 11:
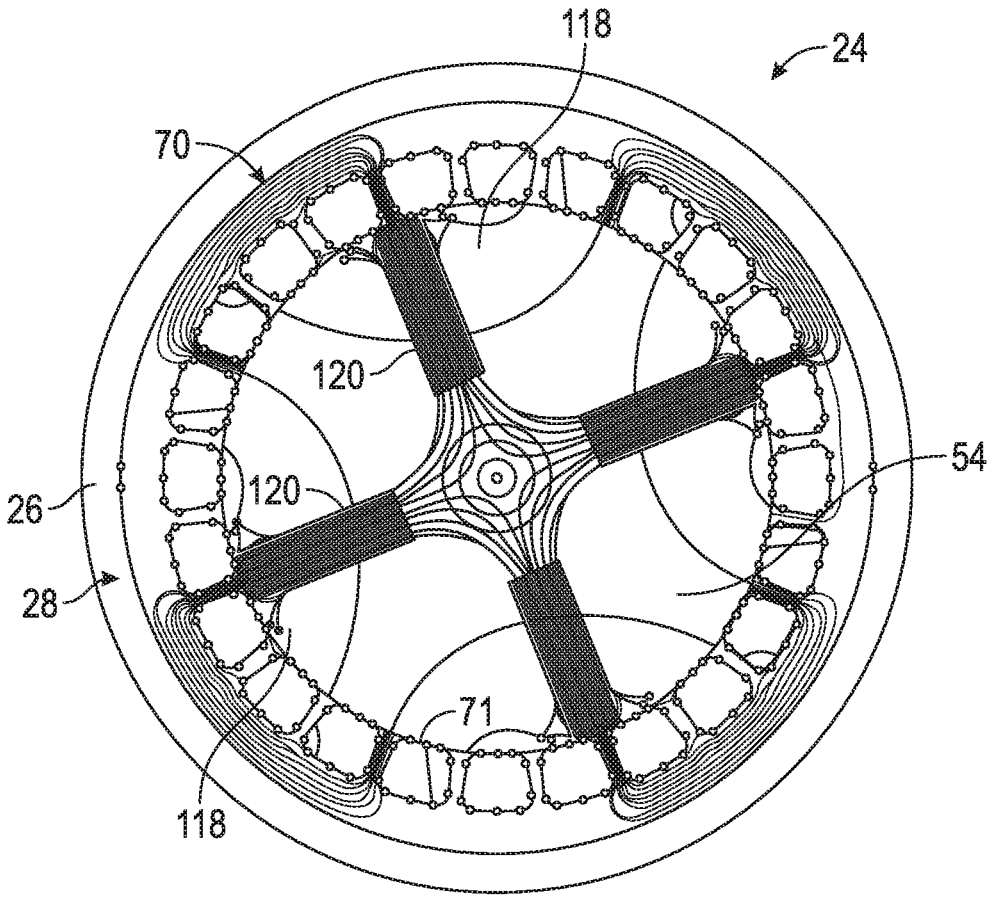
FIG. 11 is a cross-sectional illustration taken through an axis of another embodiment of the integrated pump and motor to illustrate magnetic lines, according to an embodiment of the disclosure.

In FIG. 11, a cross-sectional illustration of the integrated pump and motor 28, taken perpendicularly through the axis of the integrated pump and motor 28, is provided to show another example of an arrangement of magnetic lines 108. In this example, the impellers 54 each comprise permanent magnets 120 embedded into impeller vanes 118 which again allows the impellers 54 to function as both a motor rotor and a pump impeller simultaneously.

With respect to embodiments described herein, torque generating components (e.g. combined impeller body 66, magnetic components 64, and permanent magnet 68) may or may not be constructed to provide hydrodynamic functions of pump stage components such as impeller vanes. For example, permanent magnets 68 of impellers 54 may be constructed in the form of impeller vanes 118, may be mounted along the impeller vanes 118, or may be mounted at other suitable locations of the impellers 54 that do not participate in fluid pumping. In some embodiments, the impellers 54 may be constructed from a magnetic steel and function as a rotor of a synchronous reluctance motor. In this type of embodiment, the impellers 54 again generate torque when being exposed to a rotating magnetic field of the stator 70.

Various embodiments described herein enable the elimination of traditional ESP components such as motor protector (seal), traditional motor, traditional pump shafts, couplings, motor lead extensions, and/or other components. The integrated pump and motor 28 may be constructed to provide a combined section having a reduced number of component parts combined with a shortening of the overall length of the ESP system 20 relative to a traditional ESP system. However, multiple combined sections may be connected in tandem to provide sufficient head desired for a given pumping system.

Additionally, the integrated pump and motor 28 may be constructed with different types of fluid pumping structures, e.g. different types of impellers. For example, the fluid pumping structure 54 may be in the form of a helical rotor in a progressive cavity pump. In this type of embodiment, the helical rotor is equipped with a torque producing element, e.g. a permanent magnet element or a magnetic steel element, and surrounded by stator 70 with a winding of magnet wire 74 to produce a rotating magnetic field.

By eliminating certain traditional components, e.g. shafts, as described above, embodiments of ESP system 20 allow for the flexible connection of pumping section 24 with other components of a well string. This ability negates application restraints related to trajectory of the wellbore in three-dimensional space and facilitates use of the pumping system in wellbores with greater dogleg severity. A flexible connection between sections of the well string may be achieved by a variety of methods including use of materials which allow a certain level of deformation and flexibility, articulating joints which permit relative angular movement between connected sections, or other suitable flexible connections.

The various components of pumping system 20 may be constructed from a variety of materials. For example, the impeller body 66 may be constructed from steel, aluminum, plastic, ceramic, or other suitable materials for a given application. In some embodiments, the impellers 54 may be constructed with suitable types of magnetic material. For example, the impeller body 66 may be constructed from the same material as magnetic component 64. The magnetic components 64 also may be formed from various magnetic materials, such as magnetic steel. Similarly, the stator 70 may be constructed in various configurations using laminations 72 or other suitable structures. The electric cable 82 may have various materials and configurations and may be coupled with magnet wire 74 via various types of connectors 84, e.g. motor lead extensions. Additionally, the pumping section 24 may be combined with many other types of components in the overall pumping system.

Although a few embodiments of the system and methodology have been described in detail above, those of ordinary skill in the art will readily appreciate that many modifications are possible without materially departing from the teachings of this disclosure. Accordingly, such modifications are intended to be included within the scope of this disclosure as defined in the claims.

What is claimed is:

1. A system for use in oil and gas wells, comprising:
- an electric submersible pumping system having a fluid intake and a fluid discharge, the electric submersible pumping system comprising:
  - a housing;
  - a stator disposed within the housing, a central passage extending longitudinally through the stator;
  - a plurality of stages disposed within the central passage, each of the plurality of stages comprising:
    - a non-magnetic diffuser disposed within the central passage in a locked position with respect to the stator; and
    - a magnetic impeller disposed within the central passage in cooperation with the non-magnetic diffuser such that application of electric power to the stator causes rotation of the plurality of magnetic impellers, wherein the diffuser of each stage is positioned downstream of the impeller of the stage such that in use fluid flows through the impeller to the diffuser, and the diffuser of each stage directs the fluid to the impeller of an adjacent downstream stage; and
  - a shaft extending longitudinally through the plurality of non-magnetic diffusers and the plurality of magnetic impellers.

2. The system according to claim 1 wherein each magnetic impeller of the plurality of magnetic impellers comprises a body, a magnetic component disposed about the body, and a permanent magnet.

3. A downhole electric submersible pump configured for use in oil and gas wells, comprising:
- a stator defining a passage extending longitudinally through the stator and having a plurality of slots around the passage;
- a magnet wire extending longitudinally through at least a portion of the plurality of slots;
- a plurality of stages disposed within the passage such that the magnet wire extends along the plurality of stages, each of the plurality of stages comprising:
  - an impeller configured to rotate relative to the stator in use, the impeller of each of the plurality of stages comprising:

an impeller body;

a magnetic component about at least a portion of the impeller body; and a permanent magnet disposed about at least a portion of the magnetic component, wherein the impeller is positioned within the passage extending through the stator; and a non-magnetic diffuser locked in a stationary position relative to the stator, wherein the diffuser of each stage is positioned downstream of the impeller of the stage such that in use fluid flows through the impeller to the diffuser, and the diffuser of each stage directs the fluid to the impeller of an adjacent downstream stage; and a shaft extending longitudinally through the plurality of stages.

4. The electric submersible pump according to claim 3, wherein the impeller of each of the plurality of stages further comprises a fluid conduit for transporting a fluid from a first side of the impeller to a second side of the impeller.

5. The electric submersible pump according to claim 3 further comprising a non-magnetic diffuser associated with the impeller of each of the plurality of stages.

6. The electric submersible pump according to claim 5 wherein the diffuser comprises a fluid conduit for transporting a fluid from a first side of the diffuser to a second side of the diffuser.

7. The electric submersible pump according to claim 3 wherein the magnetic component has an annular shape.

8. The electric submersible pump according to claim 3 wherein the magnetic component comprises magnetic steel.

9. The electric submersible pump according to claim 3 further comprising a hollow shaft extending longitudinally through a center of the electric submersible pump and through the impeller of each of the plurality of stages.

10. The electric submersible pump according to claim 3 wherein the impeller body comprises a magnetic material.

11. The electric submersible pump according to claim 3 wherein the permanent magnet has an annular shape.

12. The electric submersible pump according to claim 3 wherein the stator comprises a stack of stator laminations.

13. The electric submersible pump according to claim 3 further comprising a shaft extending through the impeller of each of the plurality of stages, wherein the impeller of each of the plurality of stages rotates about the shaft.

14. The electric submersible pump according to claim 3 wherein the impeller of each of the plurality of stages rotates in response to a flow of electricity through the magnet wire.

* * * * *